US011363684B2

(12) United States Patent
Feng et al.

(10) Patent No.: US 11,363,684 B2
(45) **Date of Patent: *Jun. 14, 2022**

(54) CARBON NANOTUBE DEFROST WINDOWS

(71) Applicant: Beijing FUNATE Innovation Technology Co., LTD., Beijing (CN)

(72) Inventors: Chen Feng, Beijing (CN); Yu-Quan Wang, Beijing (CN); Li Qian, Beijing (CN)

(73) Assignee: Beijing FUNATE Innovation Technology Co., LTD., Beijing (CN)

( * ) Notice: Subject to any disclaimer, the term of this patent is extended or adjusted under 35 U.S.C. 154(b) by 846 days.

This patent is subject to a terminal disclaimer.

(21) Appl. No.: 16/227,024

(22) Filed: Dec. 20, 2018

(65) Prior Publication Data

US 2019/0150230 A1 May 16, 2019

Related U.S. Application Data

(63) Continuation of application No. 13/904,562, filed on May 29, 2013, now Pat. No. 10,225,888.

(30) Foreign Application Priority Data

Nov. 6, 2012 (CN) ..... 201210437121.3

(51) Int. Cl.
*H05B 3/86* (2006.01)

(52) U.S. Cl.
CPC ..... *H05B 3/86* (2013.01); *H05B 2203/007* (2013.01); *H05B 2203/013* (2013.01); *H05B 2214/04* (2013.01)

(58) Field of Classification Search
CPC ..... H05B 3/06; H05B 2203/007; H05B 2203/003; H05B 2214/04
USPC ..... 219/203, 202; 977/742, 743, 744
See application file for complete search history.

(56) References Cited

U.S. PATENT DOCUMENTS

| | | | | |
|---|---|---|---|---|
| 7,662,732 | B2 * | 2/2010 | Choi | B82Y 30/00 438/800 |
| 8,525,143 | B2 * | 9/2013 | Ward | G11C 13/025 257/2 |
| 10,225,888 | B2 * | 3/2019 | Feng | H05B 3/86 |
| 2009/0052029 | A1 * | 2/2009 | Dai | G02B 5/3008 359/485.02 |
| 2009/0159198 | A1 * | 6/2009 | Wang | B32B 27/08 156/281 |
| 2009/0169819 | A1 * | 7/2009 | Drzaic | H01B 1/24 428/156 |
| 2009/0268556 | A1 * | 10/2009 | Jiang | H04R 23/002 367/140 |
| 2010/0104808 | A1 * | 4/2010 | Fan | B82Y 30/00 428/143 |

(Continued)

*Primary Examiner* — Tu B Hoang
*Assistant Examiner* — Alba T Rosario-Aponte
(74) *Attorney, Agent, or Firm* — ScienBiziP, P.C.

(57) ABSTRACT

A vehicle includes a defrost window. The defrost window includes a transparent substrate, a carbon nanotube film, a first electrode, a second electrode and a protective layer. The transparent substrate has a top surface. The carbon nanotube film is disposed on the top surface of the transparent substrate. The first electrode and the second electrode electrically connect to the carbon nanotube film and space from each other. The protective layer covers the carbon nanotube film.

20 Claims, 9 Drawing Sheets

(56) References Cited

U.S. PATENT DOCUMENTS

| | | | | |
|---|---|---|---|---|
| 2010/0124645 | A1* | 5/2010 | Jiang | G06F 3/045 428/220 |
| 2011/0036828 | A1* | 2/2011 | Feng | H05B 3/342 219/529 |
| 2011/0096465 | A1* | 4/2011 | Zhou | H01B 1/04 361/502 |
| 2011/0155713 | A1* | 6/2011 | Wang | H05B 3/84 219/203 |
| 2011/0318255 | A1* | 12/2011 | Liu | C01B 32/158 423/447.2 |

* cited by examiner

CARBON NANOTUBE DEFROST WINDOWS

This application is a continuation application of U.S. patent application Ser. No. 13/904,562, filed on May 29, 2013, entitled, "CARBON NANOTUBE DEFROST WINDOWS", which claims all benefits accruing under 35 U.S.C. § 119 from China Patent Application No. 201210437121.3, filed on Nov. 6, 2012, in the China National Intellectual Property Administration, incorporated herein by reference.

BACKGROUND

1. Technical Field

The present disclosure relates to defrosting windows and vehicles using the same, particularly, to a defrosting window based on carbon nanotubes and a vehicle using the same.

2. Description of Related Art

Good visibility through the windows of a vehicle is critical for safe driving. In the morning of winter days, the windows of the vehicles often have a thin layer of frost. The frost on the windows could badly affect the driver's visibility. Therefore, it is necessary to scrape the frost off the windows of the vehicle before driving.

To get rid of the frost on the windows of the vehicles, a conductive paste of metal powder is coated on the windows to form a conductive layer. A voltage is applied to the conductive layer to generate heat and melt the frost. However, the conductive layer is not a whole structure formed on the surface of the vehicle windows. Thus, the conductive layer can shed from the vehicle windows, which will badly affect the defrosting process.

What is needed, therefore, is a defrost window with good defrosting effect, and a vehicle using the same.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
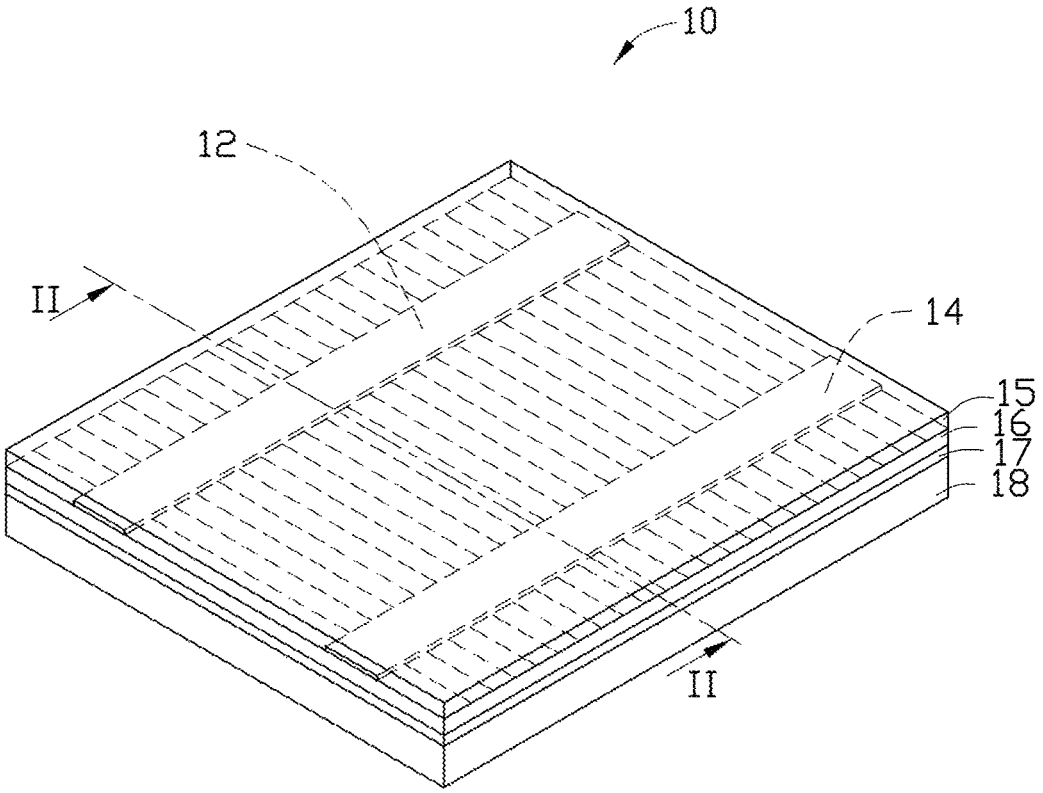
Prior Art FIG. 1
FIG. 1 is a schematic view of an embodiment of a defrost window.
Figure 2:
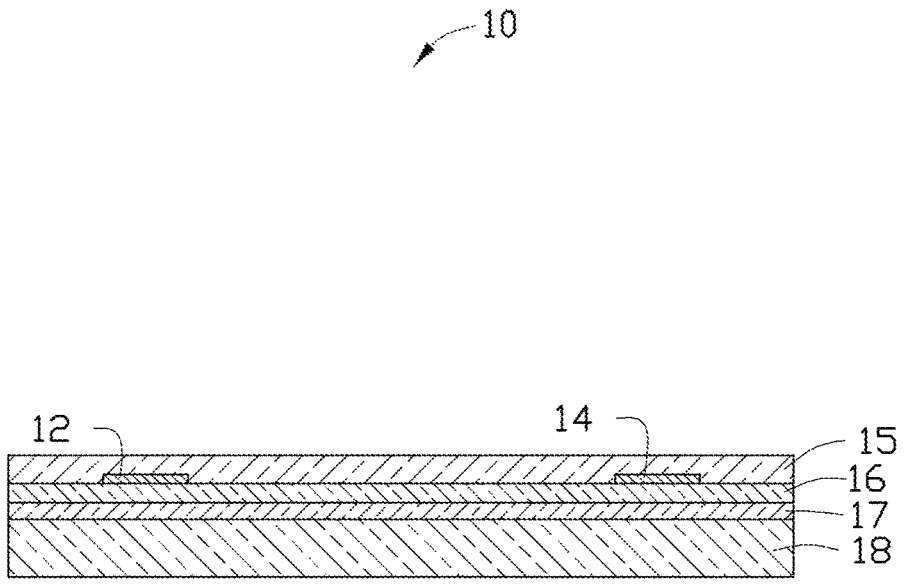
Prior Art FIG. 2
FIG. 2 is a cross-sectional view taken along a line II-II of the defrost window shown in FIG. 1.

Referring to FIG. 1 and FIG. 2, one embodiment of a defrost window 10 includes a transparent substrate 18, an adhesive layer 17, a carbon nanotube film 16, a first electrode 12, a second electrode 14, and a protective layer 15. The adhesive layer 17 can be located on a top surface of the transparent substrate 18 and a bottom surface of the carbon nanotube film 16, to adhere the carbon nanotube film 16 to the transparent substrate 18. The first electrode 12 and the second electrode 14 are electrically connected to the carbon nanotube film 16 and spaced from each other at a certain distance. The protective layer 15 is disposed on a top surface of the carbon nanotube film 16 and covers the carbon nanotube film 16, the first electrode 12, and the second electrode 14.

The transparent substrate 18 can have a curved structure or a planar structure and functions as a supporter with suitable transparency. The transparent substrate 18 may be made of a rigid material, such as glass, silicon, diamond, or plastic. The shape and size of the transparent substrate 18 is not limited, and can be determined according to need. For example, the transparent substrate 18 may be square, round, or triangular. In one embodiment, the transparent substrate 18 is a square sheet about 1 centimeter thick, and made of glass.

The adhesive layer 17 can be formed on the top surface of the transparent substrate 18 by a screen-printing method. The adhesive layer 17 may be a thermoplastic adhesive or an ultraviolet ray adhesive, such as polyvinyl polychloride (PVC) or polymethyl methacrylate acrylic (PMMA). A thickness of the adhesive layer 17 can be selected according to need, so long as the adhesive layer 17 can fix the carbon nanotube film 16 on the transparent substrate 18. The thickness of the adhesive layer 17 is in a range from about 1 nanometer to about 500 μm. In one embodiment, the thickness of the adhesive layer 17 is in a range from about 1 μm to about 2 μm. In one embodiment, the adhesive layer 17 is made of PMMA, and the thickness of the adhesive layer 17 is about 1.5 μm.

The carbon nanotube film 16 can be a free-standing structure, meaning that the carbon nanotube film 16 can be supported by itself without a substrate for support. For example, if a point of the carbon nanotube film 16 is held, the entire carbon nanotube film 16 can be supported from that point without damage. The carbon nanotube film 16 can be a substantially pure structure consisting of the carbon nanotubes with few impurities and is transparent. The carbon nanotube film 16 can be fixed on the top surface of the transparent substrate 18 firmly because the carbon nanotubes of the carbon nanotube film 16 combined by Van der Waals attractive force have good adhesion. The carbon nanotube film 16 is a whole structure, which means that the carbon nanotubes of the carbon nanotube film 16 are connected to each other, and form a free-standing structure, thus it is not easy to shed from the transparent substrate 18.

In one embodiment, the entire carbon nanotube film 16 is attached on the top surface of the transparent substrate 18 via the adhesive layer 17.

Referring to FIGS. 3-6, the carbon nanotube film 16 includes a number of carbon nanotube linear units 32 and a number of carbon nanotube groups 34. The carbon nanotube linear units 32 are spaced from each other. The carbon nanotube groups 34 join with the carbon nanotube linear units 32 by van der Waals force. The carbon nanotube groups 34 located between adjacent carbon nanotube linear units 32 are separated from each other.

Each carbon nanotube linear unit 32 includes a number of first carbon nanotubes extending substantially along a first direction X. Adjacent first carbon nanotubes extending substantially along the first direction X are joined end to end by van der Waals attractive force. In one embodiment, an axis of each carbon nanotube linear unit 32 is substantially parallel to the axes of first carbon nanotubes in each carbon nanotube linear unit 32. The carbon nanotube linear units 32 are substantially oriented along the first direction X, and are separated from each other in a second direction Y intercrossed with the first direction X.

An intersection shape of each carbon nanotube linear unit 32 can be a semi-circle, circle, ellipse, oblate spheriod, or other shapes. In one embodiment, the carbon nanotube linear units 32 are substantially parallel to each other. Distances between adjacent carbon nanotube linear units 32 are substantially equal. The carbon nanotube linear units 32 are substantially coplanar. A diameter of each carbon nanotube linear unit 32 is larger than or equal to 0.1 micrometers, and less than or equal to 100 micrometers. In one embodiment, the diameter of each carbon nanotube linear unit 32 is larger than or equal to 5 micrometers, and less than or equal to 50 micrometers. A distance between adjacent two carbon nanotube linear units 32 is not limited and can be selected as desired. In one embodiment, the distance between adjacent two carbon nanotube linear units 32 is greater than 0.1 millimeters. Diameters of the carbon nanotube linear units 32 can be selected as desired. In one embodiment, the diameters of the carbon nanotube linear units 32 are substantially equal.

The carbon nanotube groups 34 are separated from each other and combined with adjacent carbon nanotube linear units 32 by van der Waals force in the second direction Y, so that the carbon nanotube film 16 is a free-standing structure. The carbon nanotube groups 34 are alternated with the carbon nanotube linear units 32 on the second direction Y. In one embodiment, the carbon nanotube groups 34 arranged in the second direction Y are separated from each other by the carbon nanotube linear units 32. The carbon nanotube groups 34 arranged in the second direction Y can connect with the carbon nanotube linear units 32. The carbon nanotube groups 34 can be arranged in a plurality of rows.

Figure 3:
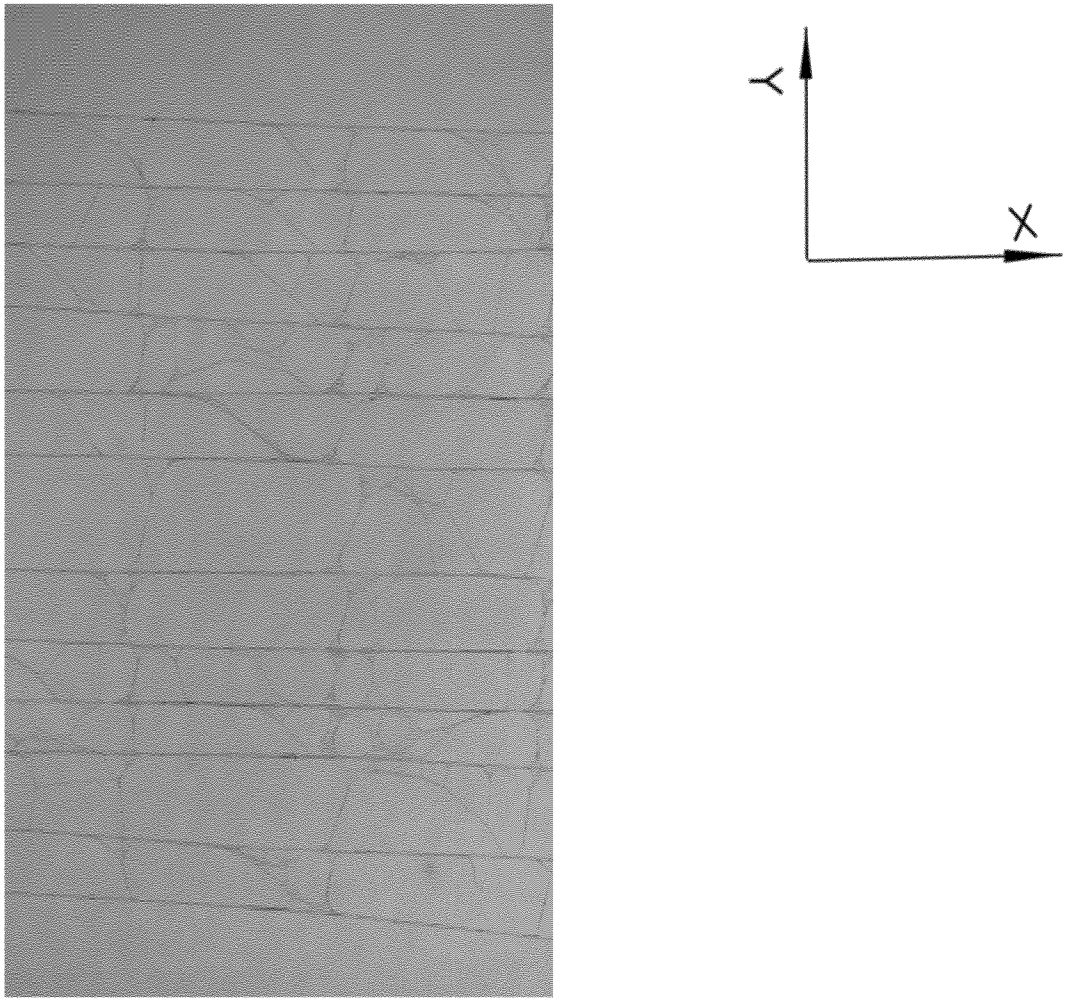
FIG. 3 is a Scanning Electron Microscope (SEM) image of a carbon nanotube film used in the defrost window of FIG. 1 according to one embodiment.
Figure 4:
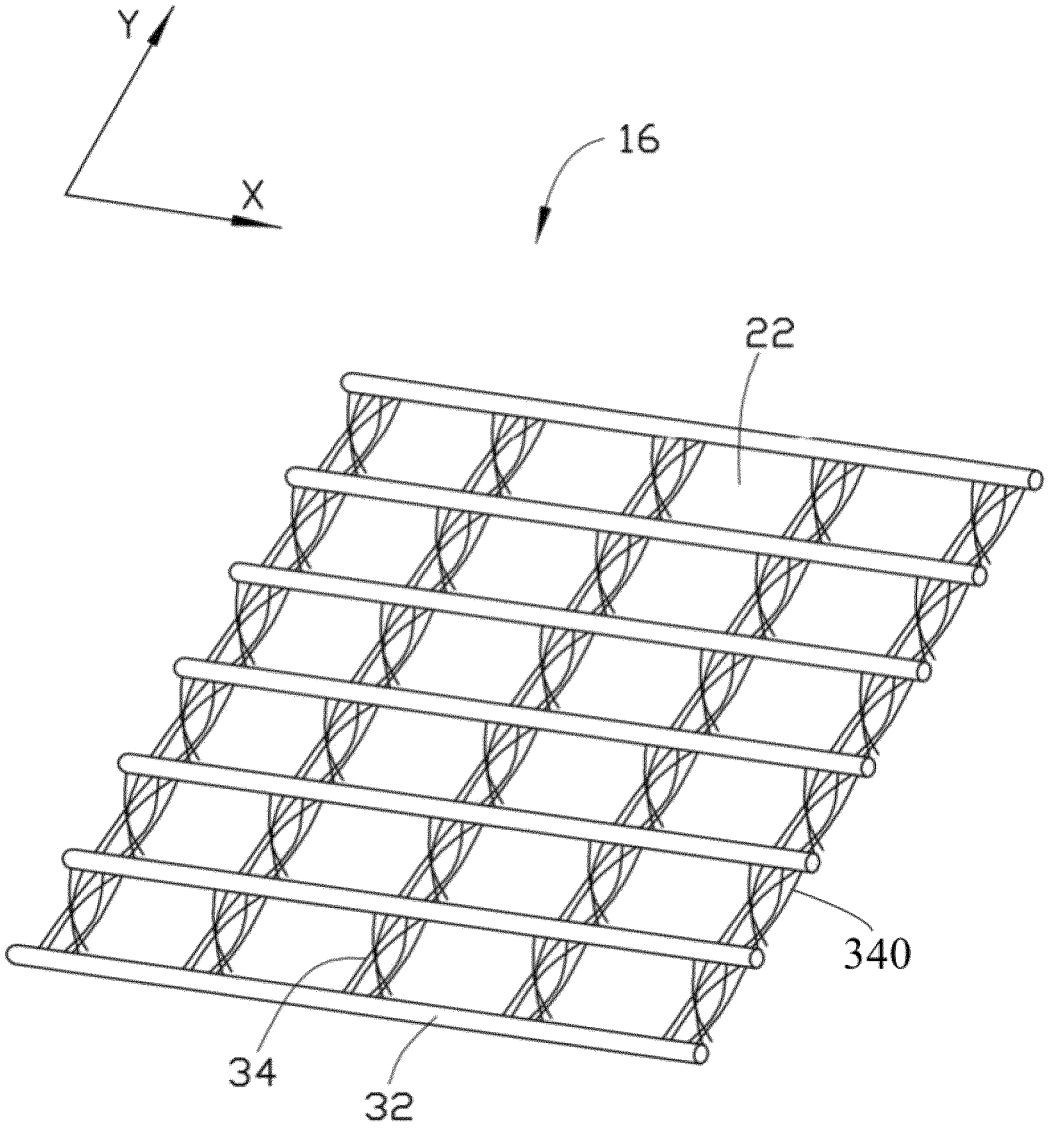
FIG. 4 is a schematic view of the carbon nanotube film in FIG. 3.
Figure 5:
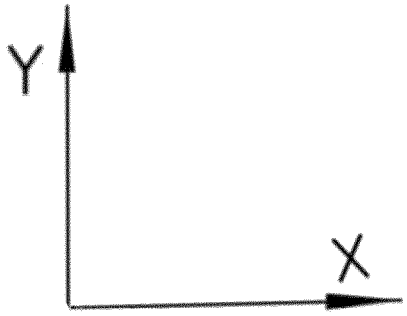
FIG. 5 is an SEM image of a carbon nanotube film used in the defrost window of FIG. 1 according to another embodiment.
Figure 5:
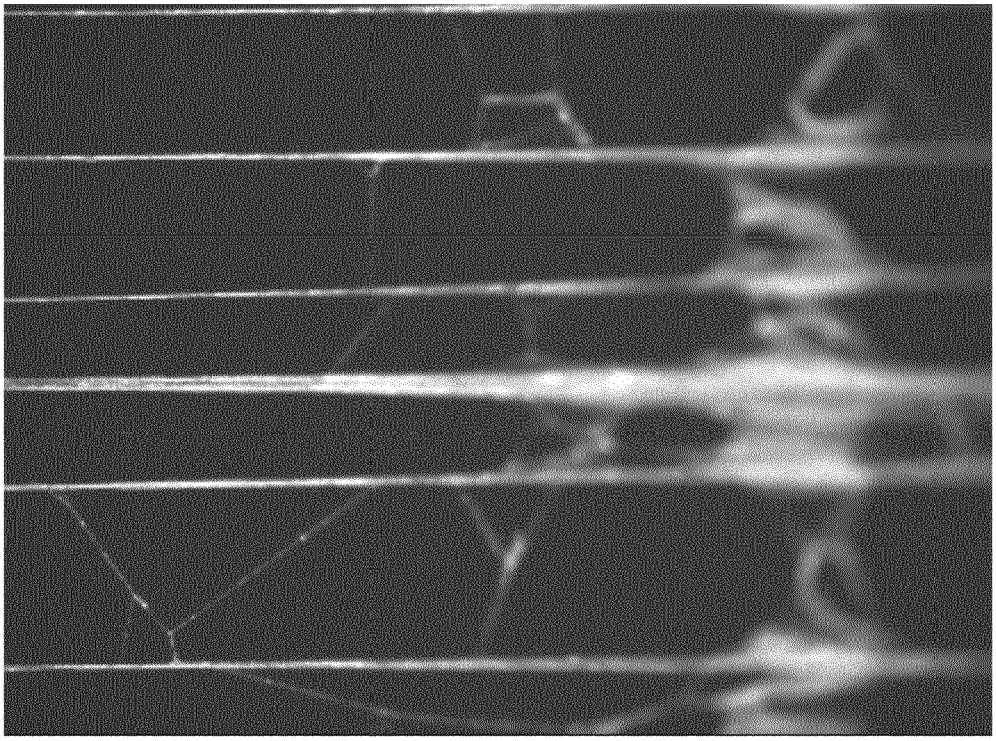
Figure 6:
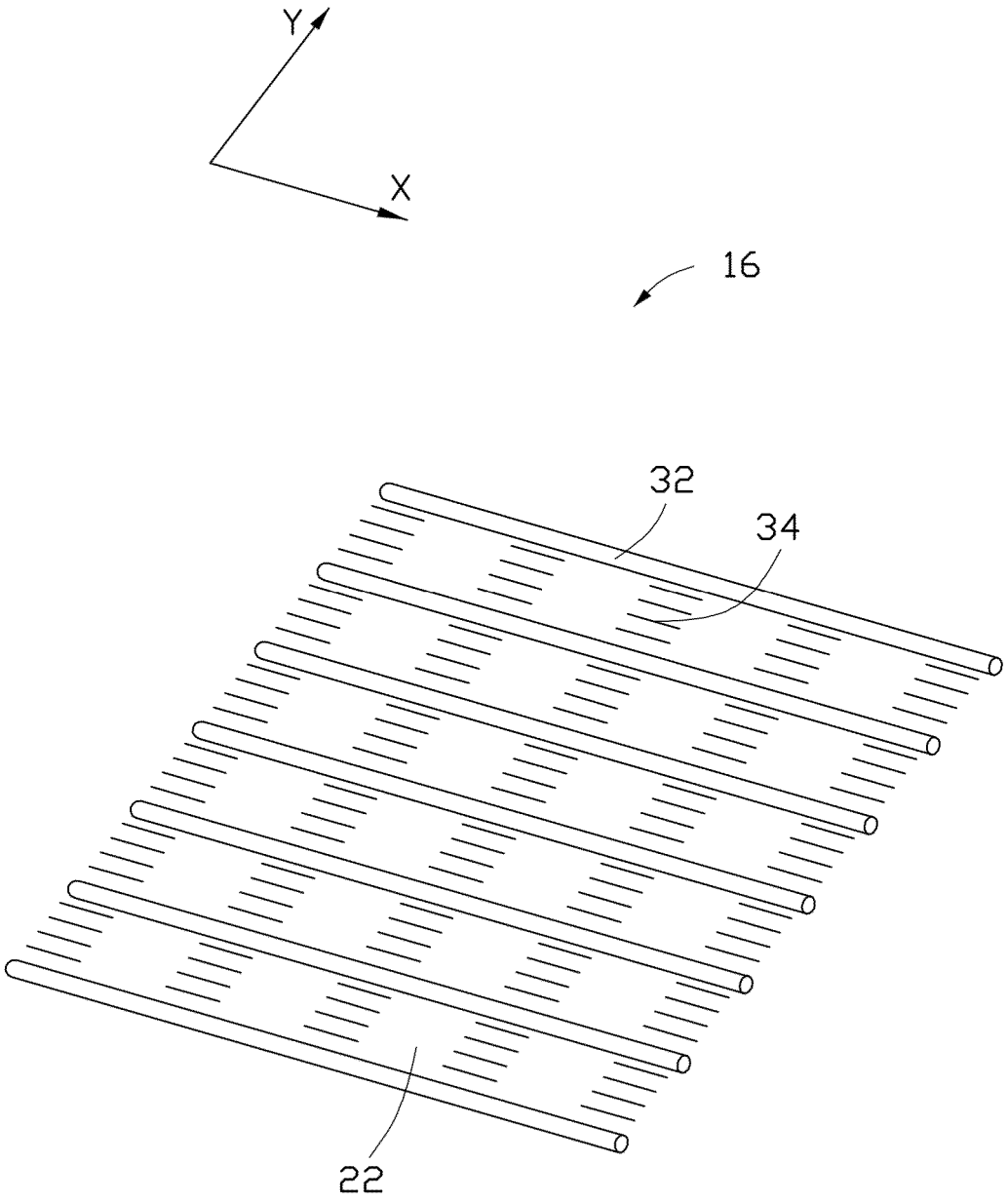
FIG. 6 is a schematic view of the carbon nanotube film in FIG. 5.

The carbon nanotube group 34 includes a number of second carbon nanotubes 340 joined by van der Waals force. Referring to FIGS. 3 and 4, in one embodiment, axes of the second carbon nanotubes 340 can intersect with the first direction X or the carbon nanotube linear units 32. The second carbon nanotubes 340 in each carbon nanotube group 34 are intercrossed to form a net like structure. In each carbon nanotube group 34, one of the second carbon nanotubes 340 intersects with each of the remaining of the second carbon nanotubes 340. Referring to FIGS. 5 and 6, the axes of the second carbon nanotubes 340 can be substantially parallel to the first direction X or the carbon nanotube linear units 32. That is, the second carbon nanotubes 340 in each carbon nanotube group 34 are substantially parallel with each other.

Therefore, the carbon nanotube film includes a number of carbon nanotubes. The carbon nanotubes can be formed into carbon nanotube linear units 32 and carbon nanotube groups 34. In one embodiment, the carbon nanotube film consists of the carbon nanotubes. The carbon nanotube film defines a number of apertures 22. Specifically, the apertures 22 are mainly defined by the separate carbon nanotube linear units 32 and the spaced carbon nanotube groups 34. The arrangement of the apertures 22 is similar to the arrangement of the carbon nanotube groups 34. In the carbon nanotube film, if the carbon nanotube linear units 32 and the carbon nanotube groups 34 are orderly arranged, the apertures 22 are also orderly arranged. In one embodiment, the carbon nanotube linear units 32 and the carbon nanotube groups 34 are substantially arranged in an array, the apertures 22 are also arranged in an array.

A ratio between a sum area of the carbon nanotube linear units 32 and the carbon nanotube groups 34 and an area of the apertures 22 is less than or equal to 1:19. That is, in the carbon nanotube film 16, a ratio of the area of the carbon nanotubes to the area of the apertures 22 is less than or equal to 1:19. In one embodiment, in the carbon nanotube film 16, the ratio of the sum area of the carbon nanotube linear units 32 and the carbon nanotube groups 34 to the area of the apertures 22 is less than or equal to 1:49. Therefore, a transparence of the carbon nanotube film 16 is greater than or equal to 95%. In one embodiment, the transparence of the carbon nanotube film 16 is greater than or equal to 98%.

The carbon nanotube film 16 is an anisotropic conductive film. The carbon nanotube linear units 32 form first conductive paths along the first direction X, as the carbon nanotube linear units 32 extend along the first direction X. The carbon nanotube groups 34 combined with the carbon nanotube linear units on the second direction form second conductive paths along the second direction Y. The second conductive paths can be curved, as the carbon nanotube groups are interlacedly arranged. The second conductive paths can be linear, as the carbon nanotube groups 34 are arranged as a number of rows. Therefore, a resistance of the carbon nanotube film 16 in the first direction X is different from a resistance of the carbon nanotube film 16 in the second direction Y. The resistance of the carbon nanotube film 16 in the second direction Y is 10 times greater than the resistance of the carbon nanotube film 16 in the first direction X. In one embodiment, the resistance of the carbon nanotube film 16 in the second direction Y is 20 times greater than the resistance of the carbon nanotube film 16 in the first direction X. In one embodiment, the resistance of the carbon nanotube film 16 in the second direction Y is about 50 times greater than the resistance of the carbon nanotube film 16 in the first direction X. In the carbon nanotube film 16, the carbon nanotube linear units 32 are joined with the carbon nanotube groups 34 in the second direction Y, which makes the carbon nanotube film 16 strong and stable, and not broken easily.

Further, there can be a few carbon nanotubes surrounding the carbon nanotube linear units and the carbon nanotube groups in the carbon nanotube film. However, these few carbon nanotubes have a small and negligible effect on the carbon nanotube film properties.

The first electrode 12 and the second electrode 14 should have good conductive properties. The first electrode 12 and the second electrode 14 can be conductive films, metal sheets, or metal lines, and can be made of pure metals, metal alloys, indium tin oxide (ITO), antimony tin oxide (ATO), silver paste, conductive polymer, and metallic carbon nanotubes, and combinations thereof. The pure metals and metal alloys can be aluminum, copper, tungsten, molybdenum, gold, cesium, palladium, or combinations thereof. The shape of the first electrode 12 or the second electrode 14 is not limited and can be for example, lamellar, rod, wire, or block shaped. In the embodiment shown in FIG. 1, the first electrode 12 and the second electrode 14 are made of ITO, and are both lamellar and substantially parallel with each other. The first electrode 12 and the second electrode 14 are both attached on a surface of the carbon nanotube film 16. The carbon nanotubes in the carbon nanotube film 16 are oriented along a direction substantially perpendicular to the first electrode 12 and the second electrode 14.

The first electrode 12 and the second electrode 14 can be disposed on a same surface or opposite surfaces of the carbon nanotube film 16. The first electrode 12 is separated from the second electrode 14 to prevent a short circuit of the electrodes. The first electrode 12 and the second electrode 14 can be electrically attached to the carbon nanotube film 16 by a conductive adhesive (not shown), such as silver adhesive. In some embodiments, the first electrode 12 and the second electrode 14 can be adhered directly to the carbon nanotube film 16 because some carbon nanotube films 16 have a large specific surface area and are adhesive in nature.

The protective layer 15 covers and protects the carbon nanotube film 16, the first electrode 12, and the second electrode 14. The protective layer 15 is made of a transparent polymer. The protective layer 15 can be made of polycarbonate (PC), PMMA, polyethylene terephthalate (PET), polyether polysulfones (PES), PVC, benzocyclobutenes (BCB), polyesters, acrylic resins, or epoxy resin. The thickness of the protective layer 15 is not limited, and can be selected according to the need. In one embodiment, the transparent substrate 18 is made of epoxy resin with a thickness about 200 micrometers.

It is to be understood that the defrost window 10 can include a number of carbon nanotube films 16 stacked one on top of another on the top surface of the transparent substrate 18. Additionally, if the carbon nanotubes in the carbon nanotube film 16 are oriented along one of the preferred orientations (e.g., the drawn carbon nanotube film), an angle can exist between the orientations of the carbon nanotubes in adjacent films, whether stacked or adjacent. Adjacent carbon nanotube films 16 can be combined by, and sometimes only by, the Van der Waals attractive force therebetween. The carbon nanotubes of at least one carbon nanotube film 16 are oriented along a direction from the first electrode 12 to the second electrode 14.

In use, when a voltage of an electrical source is applied to the carbon nanotube film 16 via the first electrode 12 and the second electrode 14, the carbon nanotube film 16 radiates heat at a certain wavelength. Therefore, the heat is transmitted to the transparent substrate 18. The frost on the defrost windows 10 melts because of the heat through the transparent substrate 18.

Figure 7:
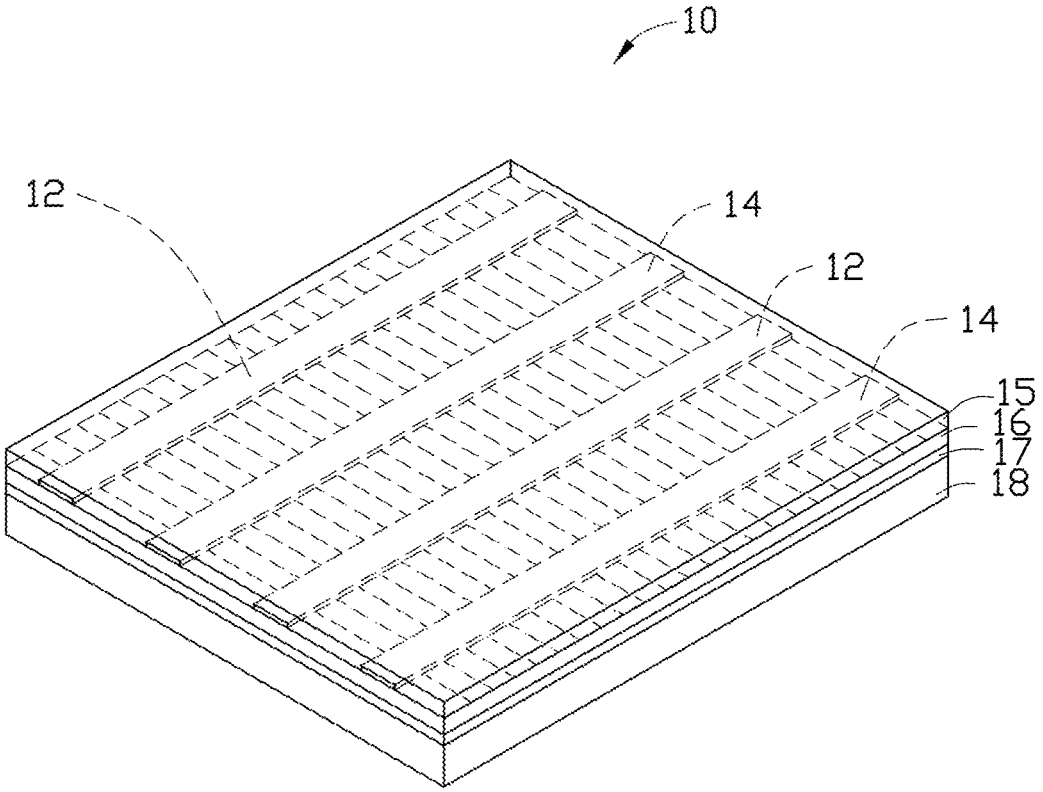
Prior Art FIG. 7
FIG. 7 is a schematic view of another embodiment of a defrost window.

Referring to FIG. 7, in another embodiment, the defrost window 10 can include a plurality of alternatively arranged first electrodes 12 and second electrodes 12. The first electrodes 12 and the second electrodes 14 can be arranged in a staggered manner, for example, side by side as shown in FIG. 7. The carbon nanotubes of in the carbon nanotube film 16 are parallel with each other and oriented along a direction from the one electrode 12 to one second electrode 14. That is, the oriented direction of the carbon nanotubes in the carbon nanotube film 16 is perpendicular with the first electrode 12 and the second electrode 14. Each first electrode 12 includes a first end (not labeled) and a second end (not labeled) opposite with the first end. Each second electrode 14 includes a third end (not labeled) and a fourth end (not labeled) opposite to the third end. The first end of the first electrode 12 is adjacent with the third end of the second electrode 14. The second end of the first electrode 12 is adjacent with the fourth end of the second electrode 14.

In use of the defrost window 10 shown in FIG. 7, a first electric potential is applied on the first end, a second electric potential is applied on the second end, whereby a first electric potential difference is formed between the first end and the second end of the first electrode 12. A third electric potential is applied on the third end, a fourth electric potential is applied on the fourth end, whereby a second electric potential difference is formed between the third end and the fourth end of the second electrode 14. The first electric potential difference is equal to the second electric potential difference. The first electric potential on the first end is different from the third electrical potential on the third end of the second electrode 14. The second electric potential on the second end of the first electrode 12 is different from the fourth electrical potential on the fourth end of the second electrode 14. In one embodiment, the first electric potential is about 10 V, the second electric potential is about 5 V; the third electric potential is about 5 V, the fourth electric potential is 0 V. A carbon nanotube has good conductivity along an axial different, and acts as if it is almost insulated along a direction perpendicular with the axial direction. When the carbon nanotubes are substantially perpendicular with the first electrode 12 or the second electrode 14, the adjacent carbon nanotubes along the first electrode 12 or the second electrode 14 will not get circuit short.

Because a first electric potential difference is formed between the first end and the second end of the first electrode 12, the first electrode 12 can generate heat; because a second electric potential difference is formed between the third end and the fourth end of the second electrode 14, the second electrode 14 can generate heat; whereby, all the areas of the defrost window 10 can generate heat, and the defrost window 10 can heat uniformly and quickly.

Figure 8:
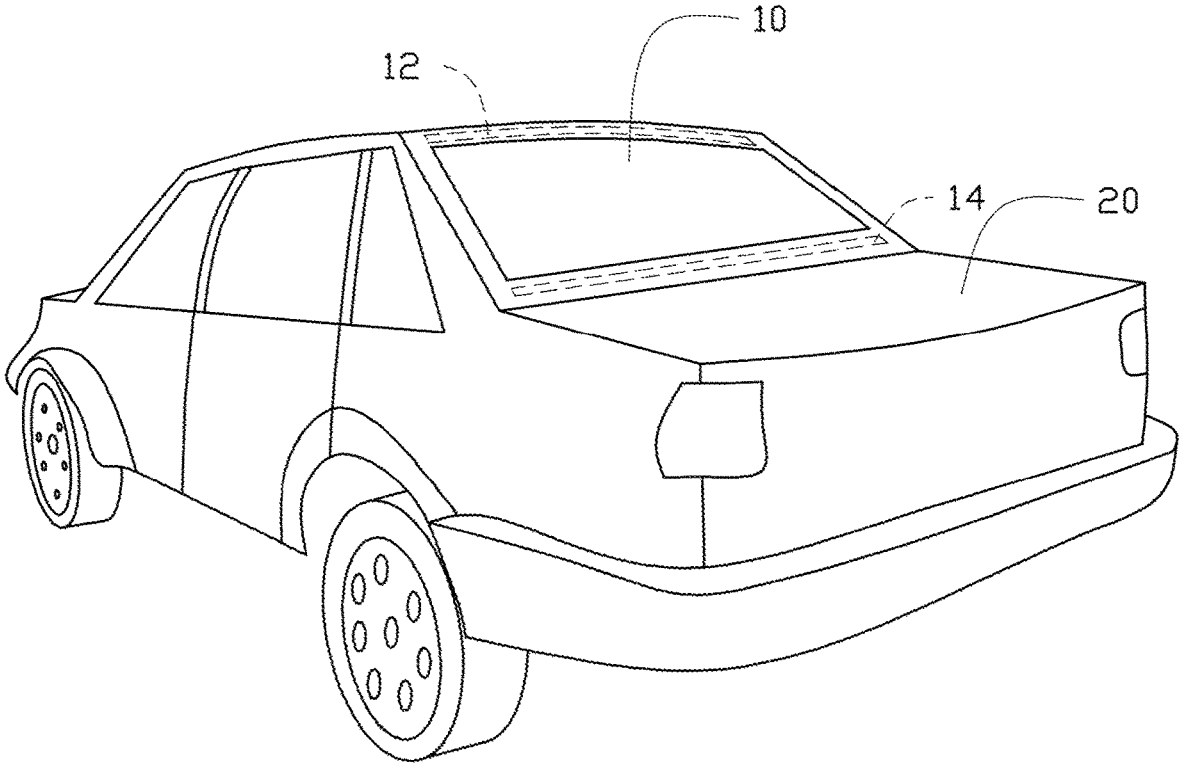
Prior Art FIG. 8
FIG. 8 is a schematic view of one embodiment of a vehicle with the defrost window of FIG. 1.

Referring to FIG. 8, one embodiment of a vehicle 20 with a defrost window 10 is provided. The defrost window 10 is used as the back window of the vehicle 20. The carbon nanotube film 16 of the defrost window 10 faces inside the vehicle 20. The first electrode 12 and the second electrode 14 are electrically connected to an electrical source system of the vehicle 20. The defrost window 10 can also be used as the front or side windows of the vehicle 20, because the defrost window 10 is transparent.

Figure 9:
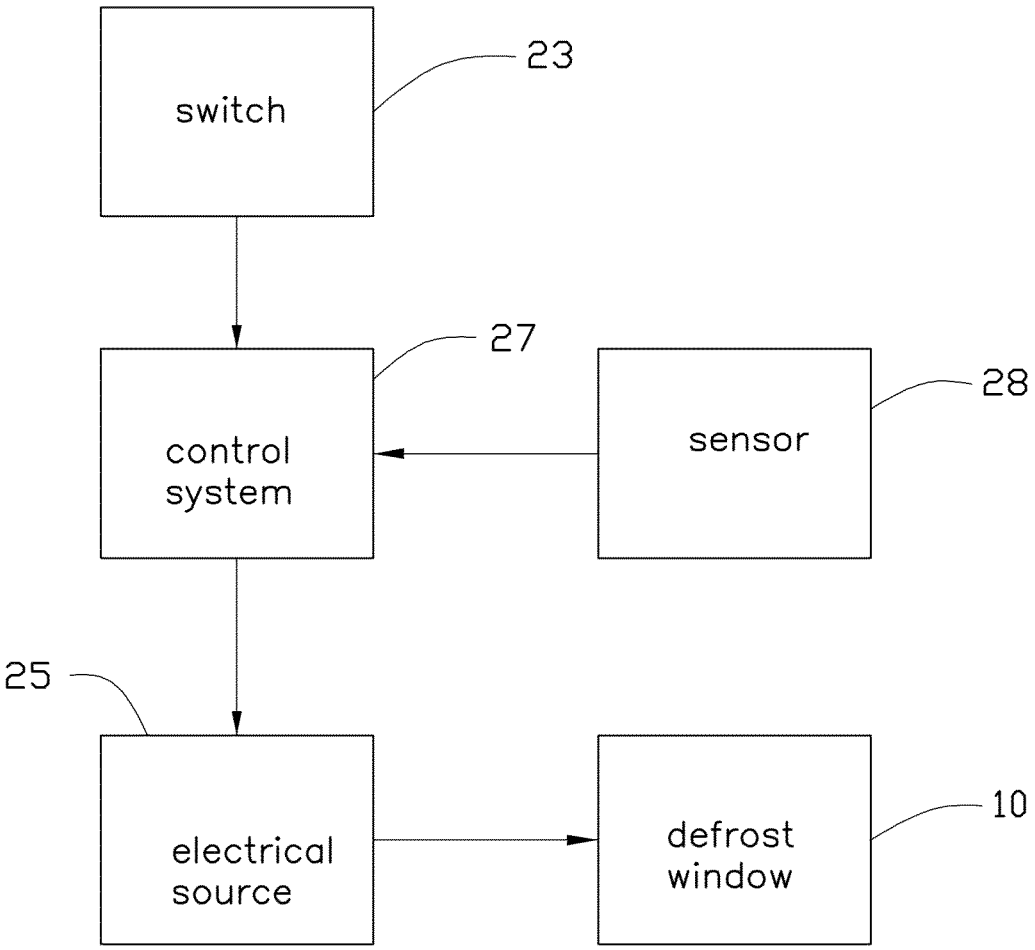
FIG. 9 is a schematic view of one embodiment of a defrost system with a defrost window used in a vehicle.

Referring to FIG. 9, in use, the vehicle 20 further includes a control system 27, a switch 23, a sensor 28, and an electrical source 25. The control system 27 is electrically connected to the electrical source 25, to control a voltage of the electrical source 25. The electrical source 25 is electrically connected to the defrost window 10 via the first electrode 12 and the second electrode 14, thus a voltage can be applied on the defrost window 10. The switch 23 is electrically connected to the control system 27 and can be controlled by an operator of the vehicle 20. The sensor 28 is electrically connected with the control system 27, and can detect the frost on the defrost window 10. When there is frost on the surface of the defrost window 10, the sensor 28 will send a signal to the control system 27, whereby the control system 28 will control the defrost window 10 to work.

It is to be understood that the application of the defrost window 10 is not limited to vehicles, and can be used in other applications such as building windows or other surfaces which needs frost reduced.

It is to be understood that the above-described embodiments are intended to illustrate rather than limit the present disclosure. Any elements described in accordance with any embodiments is understood that they can be used in addition or substituted in other embodiments. Embodiments can also be used together. Variations may be made to the embodiments without departing from the spirit of the present disclosure. The above-described embodiments illustrate the scope, but do not restrict the scope of the present disclosure.

What is claimed is:

1. A vehicle, comprising:

at least one defrost window, comprising:

a transparent substrate having a top surface;

a carbon nanotube film attached on the top surface, wherein the carbon nanotube film consists of a plurality of carbon nanotube linear units and a plurality of carbon nanotube groups alternatively arranged; the plurality of carbon nanotube linear units are spaced apart from each other and parallel to each other, and each of the plurality of carbon nanotube linear units comprises a plurality of first carbon nanotubes extending along a first direction; the plurality of carbon nanotube groups which are between adjacent two of the plurality of carbon nanotube linear units are spaced apart from each other along the first direction, and each of the plurality of carbon nanotube groups consists of a plurality of second carbon nanotubes, and one of the plurality of second carbon nanotubes intersects with each of a remaining of the plurality of second carbon nanotubes;

a first electrode and a second electrode electrically connected to the carbon nanotube film and spaced apart from each other; and a protective layer covering the carbon nanotube film;

an electrical source electrically connected between the first electrode and the second electrode and configured to apply electrical current to the carbon nanotube film; and a sensor configured to detect frost on the at least one defrost window.

2. The vehicle of claim 1, wherein the sensor is configured to send a signal when the frost on the at least one defrost window is detected by the sensor.

3. The vehicle of claim 1, wherein the carbon nanotube film comprises a plurality of apertures, and each of the plurality of apertures is defined by adjacent carbon nanotube linear units and adjacent carbon nanotube groups.

4. The vehicle of claim 1, wherein the plurality of carbon nanotube groups are combined with the plurality of carbon nanotube linear units by van der Waals force, and the carbon nanotube film is a free-standing structure.

5. The vehicle of claim 1, wherein the plurality of carbon nanotube linear units and the plurality of carbon nanotube groups are arranged in a same plane.

6. The vehicle of claim 1, wherein the plurality of second carbon nanotubes intersect with each other.

7. The vehicle of claim 1, wherein a length direction of each of the plurality of second carbon nanotubes are parallel to the first direction.

8. The vehicle of claim 1, wherein the plurality of first carbon nanotubes are joined end to end by van der Waals attractive force.

9. The vehicle of claim 1, wherein a distance between adjacent two of the plurality of carbon nanotube groups along the first direction is greater than 1 millimeter.

10. The vehicle of claim 1, wherein the plurality of carbon nanotube groups are arranged along a second direction to form a plurality of rows, and the second direction is perpendicular to the first direction.

11. A vehicle, comprising:

at least one defrost window, comprising:

a transparent substrate having a top surface;

a carbon nanotube film attached on the top surface, wherein the carbon nanotube film comprises a plurality of carbon nanotube linear units and a plurality of carbon nanotube groups; the plurality of carbon nanotube linear units are spaced apart from each other and parallel to each other, and each of the plurality of carbon nanotube linear units comprises a plurality of first carbon nanotubes extending along a first direction; the plurality of carbon nanotube groups which are between adjacent two of the plurality of carbon nanotube linear units are spaced apart from each other along the first direction, each of the plurality of carbon nanotube groups comprises a plurality of second carbon nanotubes, the plurality of carbon nanotube groups are arranged along a second direction to form a plurality of rows, and the second direction is perpendicular to the first direction; and a first distance between adjacent two of the plurality of carbon nanotube groups along the first direction is greater than a second distance between adjacent two of the plurality of second carbon nanotubes;

at least one first electrode and at least one second electrode electrically connected to the carbon nanotube film and spaced apart from each other, and a protective layer covering the carbon nanotube film;

an electrical source electrically connected between the first electrode and the second electrode and configured to apply electrical current to the carbon nanotube film; and a sensor configured to detect frost on the at least one defrost window.

12. The vehicle of claim 11, wherein the plurality of second carbon nanotubes intersect with each other.

13. The vehicle of claim 11, wherein a length direction of each of the plurality of second carbon nanotubes is parallel to the first direction.

14. The vehicle of claim 11, wherein each of the plurality of carbon nanotube groups consists of the plurality of second carbon nanotubes.

15. The vehicle of claim 11, wherein an axial direction of the plurality of carbon nanotube linear units is along the first direction, and a distance between adjacent two of the plurality of carbon nanotube groups along the axial direction is greater than 1 millimeter.

16. The vehicle of claim 11, wherein the plurality of carbon nanotube groups are combined with the plurality of carbon nanotube linear units by van der Waals force, and the carbon nanotube film is a free-standing structure.

17. The vehicle of claim 11, wherein the plurality of carbon nanotube linear units and the plurality of carbon nanotube groups are arranged in a same plane.

18. The vehicle of claim 11, wherein the plurality of first carbon nanotubes are joined end to end by van der Waals attractive force.

19. The vehicle of claim 11, wherein the sensor is configured to send a signal when the frost on the at least one defrost window is detected by the sensor.

20. The vehicle of claim 1, wherein a first distance between adjacent two of the plurality of carbon nanotube groups along the first direction is greater than a second distance between adjacent two of the plurality of second carbon nanotubes.

* * * * *